US005345906A

United States Patent [19]

Luczak

[11] Patent Number: 5,345,906

[45] Date of Patent: Sep. 13, 1994

[54] FUEL INJECTION APPARATUS

[76] Inventor: John R. Luczak, 1203 Lindberg Ave., Pittsburgh, Pa. 15223

[21] Appl. No.: 95,151

[22] Filed: Jul. 20, 1993

[51] Int. Cl.[5] ..... F02B 3/00

[52] U.S. Cl. ..... 123/299

[58] Field of Search ..... 123/299, 294, 276, 73 C

[56] References Cited

U.S. PATENT DOCUMENTS

| | | | |
|---|---|---|---|
| 1,544,524 | 6/1925 | Banner | 123/299 |
| 1,644,557 | 10/1927 | Banner | 123/299 |
| 2,805,654 | 9/1957 | Jacklin | 123/294 |
| 3,023,743 | 3/1962 | Schauer, Jr. | 123/294 |
| 3,664,818 | 5/1972 | Kramer | 123/299 |
| 4,070,826 | 1/1978 | Stenger et al. | 60/39.66 |
| 4,359,191 | 11/1982 | Uchida | 239/533.5 |
| 4,702,414 | 10/1987 | Hirabayashi et al. | 239/4 |
| 4,790,270 | 12/1988 | McKay et al. | 123/73 C |
| 4,858,578 | 8/1989 | Schereer et al. | 123/276 |
| 4,858,579 | 8/1989 | Elsbett et al. | 123/299 |
| 4,872,433 | 10/1989 | Paul et al. | 123/257 |
| 4,924,828 | 5/1990 | Oppenheim | 123/299 |

FOREIGN PATENT DOCUMENTS

| | | | |
|---|---|---|---|
| 952042 | 11/1956 | Fed. Rep. of Germany | 123/299 |
| 362146 | 12/1931 | United Kingdom | 123/325 |
| 401796 | 11/1933 | United Kingdom | 123/299 |

*Primary Examiner*—Raymond A. Nelli

*Attorney, Agent, or Firm*—John P. O'Banion; John Costello

[57] ABSTRACT

An injection apparatus for delivering material from a first location to another location under pressure through a series of passages is disclosed herein. The injection apparatus is comprised of an injector body (10) which can be coupled to a pressurization means (50). The injector body (10) is comprised of top (12), middle (14) and bottom (18) plate-like members, the middle members (14) having linear indentations (16) chemically etched upon their surfaces, the linear indentations (16) creating a series of passages (40) upon stacking the members in precise order. The passages (40) serve as routes for delivering material from a first location to one or more other locations. The pressurization means (50) facilitates the movement of material throughout the injector body (10) of the present invention.

14 Claims, 5 Drawing Sheets

FUEL INJECTION APPARATUS

BACKGROUND OF THE INVENTION

1. Field of the Invention

This invention pertains generally to fuel injectors for internal combustion engines, and more particularly to a fuel injection apparatus which delivers fuel to an engine cylinder through a plurality of injector ports disposed in a circular fashion around the cylinder, the apparatus being conveniently adapted to fit between an engine block and a cylinder head.

2. Description of the Background Art

Fuel injection in internal combustion engines has provided an efficient alternative to traditional carburetion methods for a number of years. By feeding fuel directly to the cylinders rather than going first through an intake manifold, fuel injection systems avoid the "lag" commonly experienced with carburetors. Hence fuel injection provides an efficient means of fueling an internal combustion engine and achieving optimum performance.

A traditional method of fuel injection has been to position the fuel ports in the cylinder head, thereby injecting fuel downward from the top of the cylinder. Such an arrangement of the fuel ports produces incomplete and inefficient burning of the vapor mixture during combustion, because the fuel vapor temperature furthest from the fuel injector drops significantly, before combustion is complete. This results in carbon and unburned fuel being expelled in the exhaust.

Various alternative approaches to traditional fuel injection can be found. For example, German patent 952,042 issued Nov. 8, 1956, discloses a fuel injection system having circularly disposed injector ports which inject fuel from the side of the cylinder. U.S. Pat. No. 4,970,270 issued to McKay et al. on Dec. 13, 1988, discloses injecting fuel through one side of the cylinder of an engine where the fuel is sprayed in a number of streams. The streams are directed, upward, downward and across the cylinder. British patent 401,796 issued to Hasson et al. on Nov. 23, 1933 discloses injecting fuel through opposing sides of the cylinder of an engine, where multiple sprays of fuel fan out across the top of the piston. British patent 362,146 issued to Lang on Dec. 3, 1931, discloses the use of "plugs" rather than fuel injectors. The plugs are inserted into the side of the cylinder in circular fashion for purposes of spraying a circular pattern of fuel. In addition to functioning to deposit fuel, the plugs also serve as auxiliary compression chambers. U.S. Pat. Nos. 1,644,557 and 1,544,524 issued on Oct. 4, 1927 and Jun. 30, 1925 respectively, both disclose side injection systems which are disposed between the cylinder head and block of an engine. U.S. Pat. No. 2,805,654 issued to Jacklin on Sep. 10, 1957, discloses an opposed piston two-cycle engine which has a means for introducing fuel to the cylinder in a circular fashion. U.S. Pat. 3,023,743 issued to Schauer on Mar. 6, 1962, discloses an opposed piston engine with circular inlet ports disposed around the cylinder wall.

In addition, the following U.S. Pat. Nos. disclose a variety of other types of fuel injection systems and are of interest: 4,702,414, 3,664,818, 4,359,191, 4,070,826, 4,858,578, 4,858,579.

The fuel injection devices disclosed in the foregoing patents still do not provide for complete and efficient combustion of the fuel, add to the size and complexity of the engine, and increase the amount of maintenance required. Therefore, there is a need for an apparatus which provides for injection of fuel into the combustion chamber evenly, efficiently and at a uniform pressure, which does not add to the complexity or size of the engine, and which is easy to maintain. The present invention satisfies those needs, as well as overcomes the deficiencies in fuel injection devices heretofore developed.

The foregoing patents reflect the state of the art of which the applicant is aware and are tendered with the view toward discharging applicant's acknowledged duty of candor in disclosing information which may be pertinent in the examination of this application. It is respectfully stipulated, however, that none of these patents teach or render obvious, singly or when considered in combination, applicant's claimed invention.

SUMMARY OF THE INVENTION

The present invention generally pertains to a plate-like, circular feed, fuel injection apparatus which is placed between the cylinder head and the block of an internal combustion engine. The invention generally comprises a one-piece, generally planar injector body which communicates with a pressurizing means.

By way of example and not of limitation, the injector body of the present invention comprises a plurality of plate-like members, having cutouts placed into their surfaces. The plate-like members are divided into top, middle and bottom members. The middle members have patterns placed into their surfaces, the patterns consisting of linear indentations terminating at one or more of the cutouts. The depth of the linear indentations which comprise the patterns varies from member to member, with the innermost of the middle members preferably having linear indentations penetrating these members, and the outermost of the middle members preferably having linear indentations penetrating only partially into their surfaces. The top, middle and bottom members are stacked upon each other in a precise order, the middle members having the deepest indentations preferably occupying the innermost position in the stack. The top, middle and bottom members are then bonded together, using a suitable means. When the members are bonded, the linear indentations of each middle member communicate in a precise order to create passages which follow the path of the original patterns of indentations. Additionally, the stacking of the members causes the cutouts to build upon each other, thus creating cavities where the cutouts once resided.

The cavities are divisible into inlet cavities and outlet cavities, the inlet cavities possessing inlet ports and the outlet cavities possessing outlet ports. The passages communicate between the inlet cavities and the outlet cavities, the inlet ports and outlet ports representing the respective ends of the passages. The inlet ports allow material to leave the inlet cavity, while the outlet ports allow material to enter the outlet cavity. The inlet cavity has at least one passage devoted to receiving fuel or other material from an external source such as a fuel pump. This passage terminates at the inlet cavity at a fuel feed port. Additionally, the inlet cavity is designed to communicate closely with a pressurization means which alternately creates a negative pressure and a positive pressure within the inlet cavity, material being drawn into the inlet cavity from an external source during a negative pressure and being discharged from the inlet cavity during a positive pressure. Upon being discharged from the inlet cavity, the material travels within the passages to the outlet cavity to be injected into the outlet cavity through a series of outlet ports. The materials injected can range from combustible fuels such as gasoline, to coolants such as water or the like. If desired, coolants can be injected to cool the combustion chamber prior to injecting fuel.

The injector body of the present invention is designed to be positioned between the cylinder head and block of an engine, the outlet cavity preferably being circular and of a circumference approximate to that of the engine cylinder. The material is thus injected into the cylinder from the outlet ports residing in the walls of the outlet cavity.

An object of the invention is to provide an injection apparatus having passages for delivering fuel and other materials.

Another object of the invention is to provide an injection apparatus which injects fuel in a circular pattern into an engine cylinder.

Another object of the invention is to provide an injection apparatus having a pressurization means for facilitating the movement of fuel or other materials.

Still another object of the invention is to provide an injection apparatus whereby fuel or other material is burned more efficiently.

Further objects and advantages of the invention will be brought out in the following portions of the specification, wherein the detailed description is for the purpose of fully disclosing preferred embodiments of the invention without placing limitations thereon.

BRIEF DESCRIPTION OF THE DRAWINGS

The invention will be more fully understood by reference to the following drawings which are for illustrative purposes only.

DESCRIPTION OF THE PREFERRED EMBODIMENTS

Figure 1:
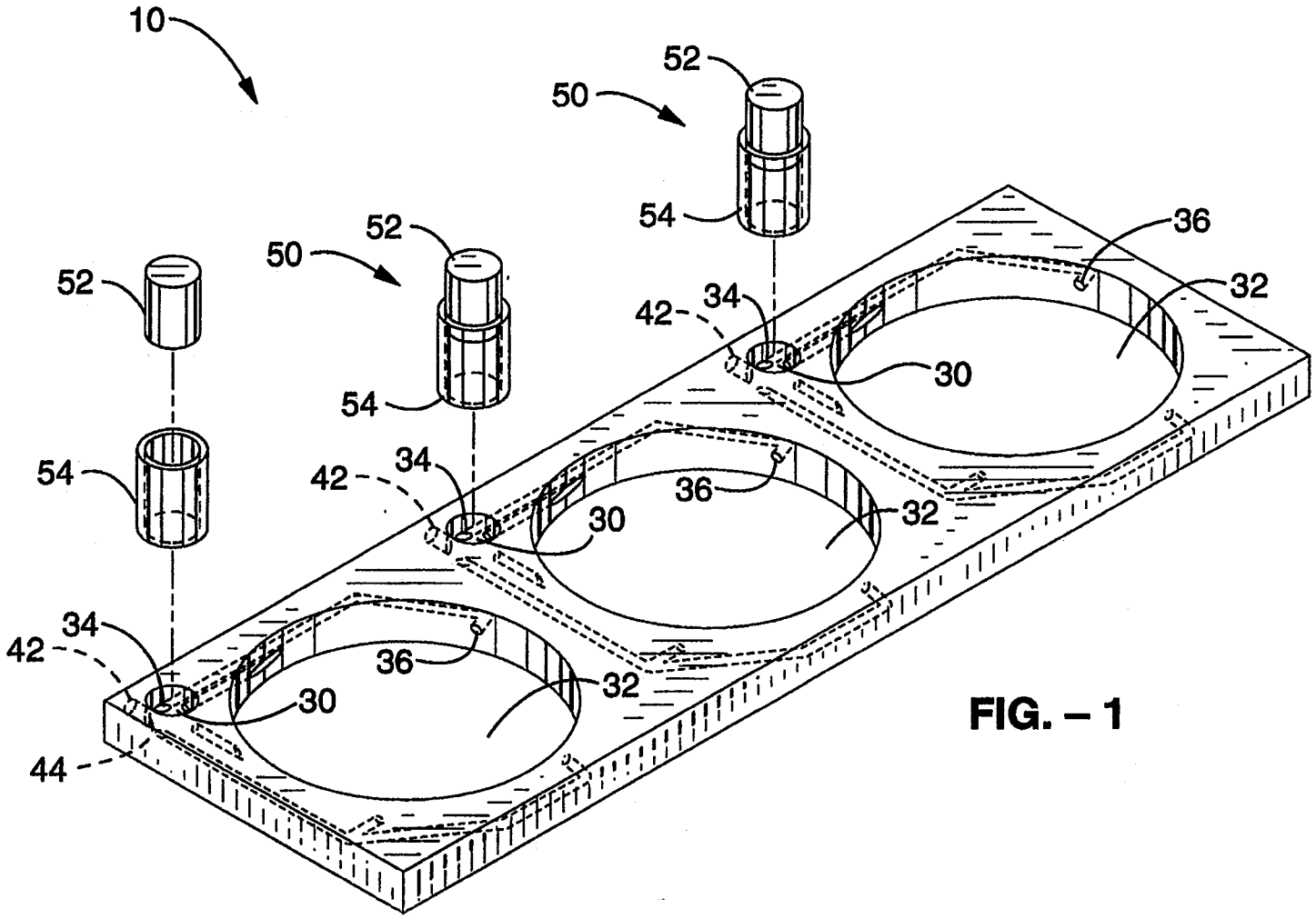
FIG. 1 is a perspective view of the injection apparatus of the present invention with the pressurization means exploded therefrom to show the relation of the pressurization means to the injector body.
Figure 2:
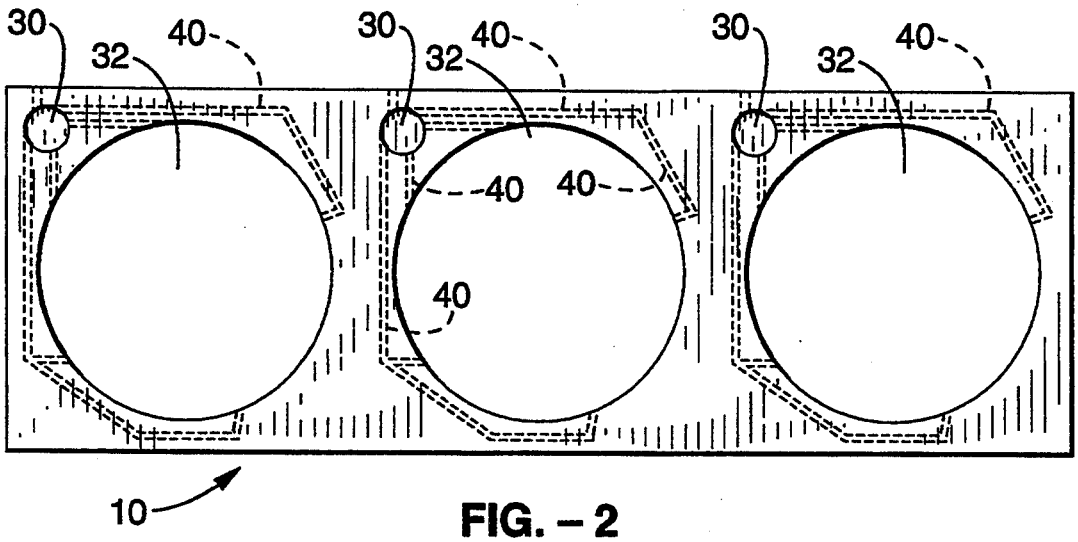
FIG. 2 is a plan view of the injector body portion of FIG. 1.

Referring more specifically to the drawings, for illustrative purposes the present invention is embodied in the apparatus generally shown in FIG. 1. It will be appreciated that the apparatus may vary as to configuration and as to details of the parts without departing from the basic concepts as disclosed herein.

Figure 3:
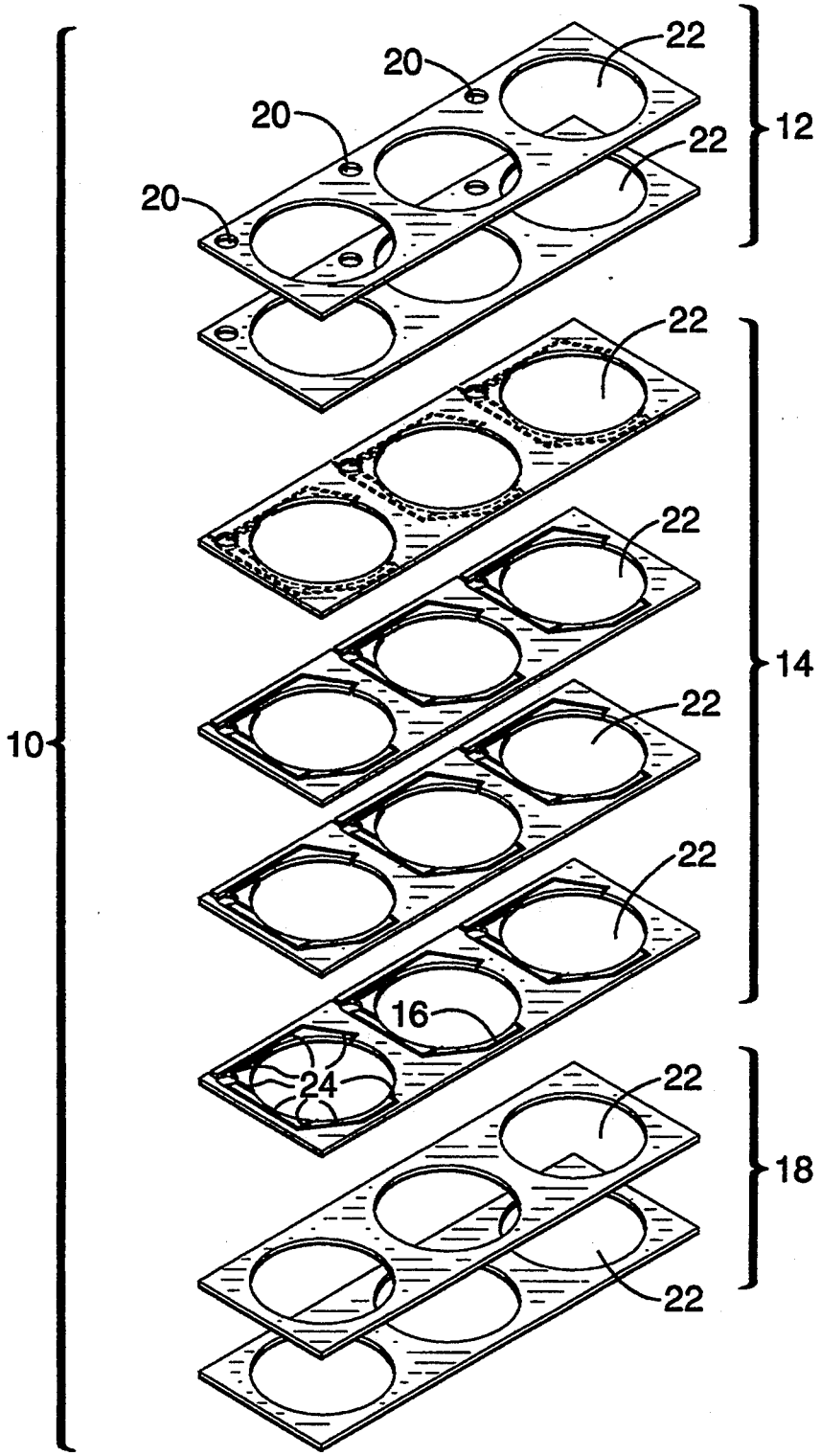
FIG. 3 is an exploded view of the injector body portion of FIG. 1.
Figure 4:
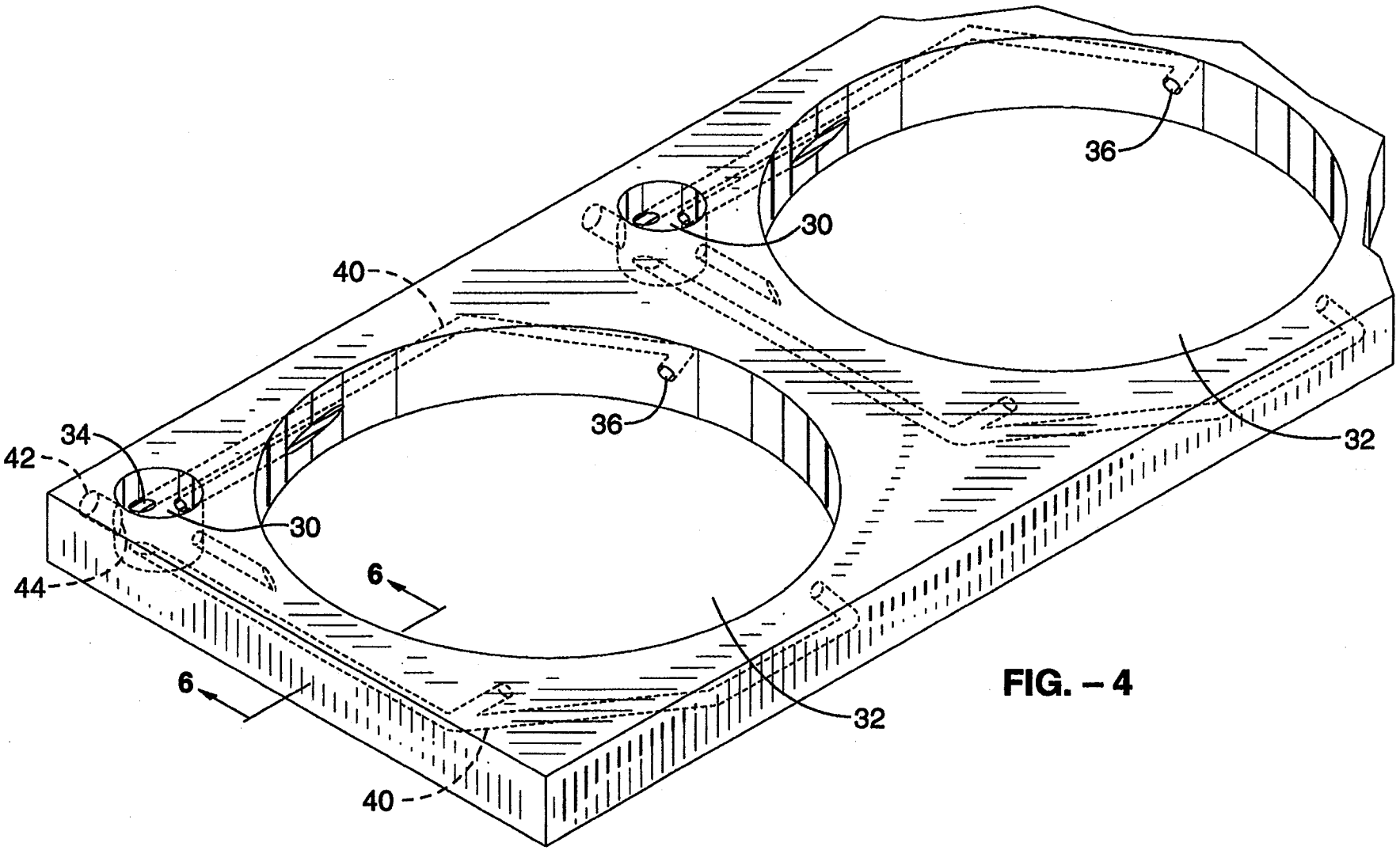
FIG. 4 is an enlarged perspective view of a portion of the injector body of FIG. 2.

Referring to FIG. 1 through FIG. 4, the apparatus of the present invention generally comprises an injector body 10 which is configured and structured for coupling to a pressurization means 50. The injector body 10 is preferably formed as a lamination of a plurality of rigid or semi-rigid generally planar plate-like members as shown in FIG. 3, the members being divided into top members 12, middle members 14 and bottom members 18. Injector body 10 can be fabricated from a variety of materials, including aluminum, steel, plastic, ceramic or the like, or combinations thereof, provided that the material is impervious to fuel or other reactive materials. In addition, there is no requirement that the plate-like members be of uniform composition throughout the injector body. Also the precise number of top members 12, middle members 14 and bottom members 18 is not limited, and can vary throughout the injector body 10. The thickness of each of the members is limited only by the practical requirements of the invention and the top, middle and bottom members may vary in thickness.

As shown in FIG. 3, the top members 12 and middle members 14 preferably include a first cutout 20 and a second cutout 22 placed thereupon. Second cutout 22 is also included in bottom members 18. Additionally, the members have patterns 24 placed upon their surfaces and it is preferable that only the middle members 14 have these patterns 24. The patterns 24 preferably are comprised of linear indentations 16 which communicate with cutouts 20 and 22. The patterns 24 are preferably identical on each of the middle members 14 with regard to appearance, however, they preferably vary from middle member 14 to middle member 14 with regard to the depth of the linear indentations 16. The patterns 24 may be placed upon the surfaces of the middle members 14 by a variety of methods, however it is preferable that a chemical etching process be used to place the patterns 24 upon the surfaces of the middle layers 14. By using a chemical etching process a high degree of precision regarding the depths and shapes of linear indentations 16 can be achieved, resulting in configurations and numbers of patterns 24 which are unlimited.

Figure 6:
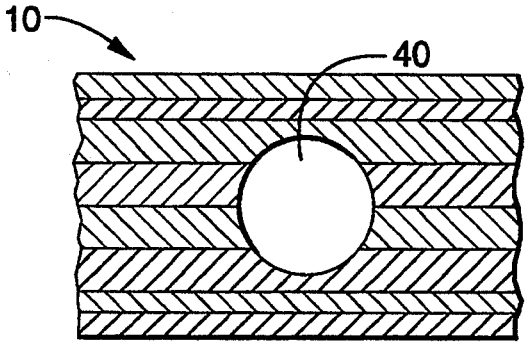
FIG. 6 is a cross section view of a portion of the injector body shown in FIG. 4 taken through line 6—6 to show a passageway of the apparatus in cross section.
Figure 7:
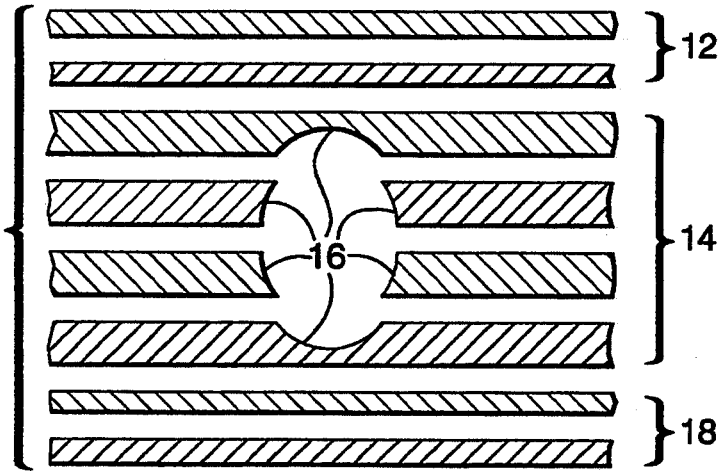
FIG. 7 is an exploded view of FIG. 6.
Figure 5:
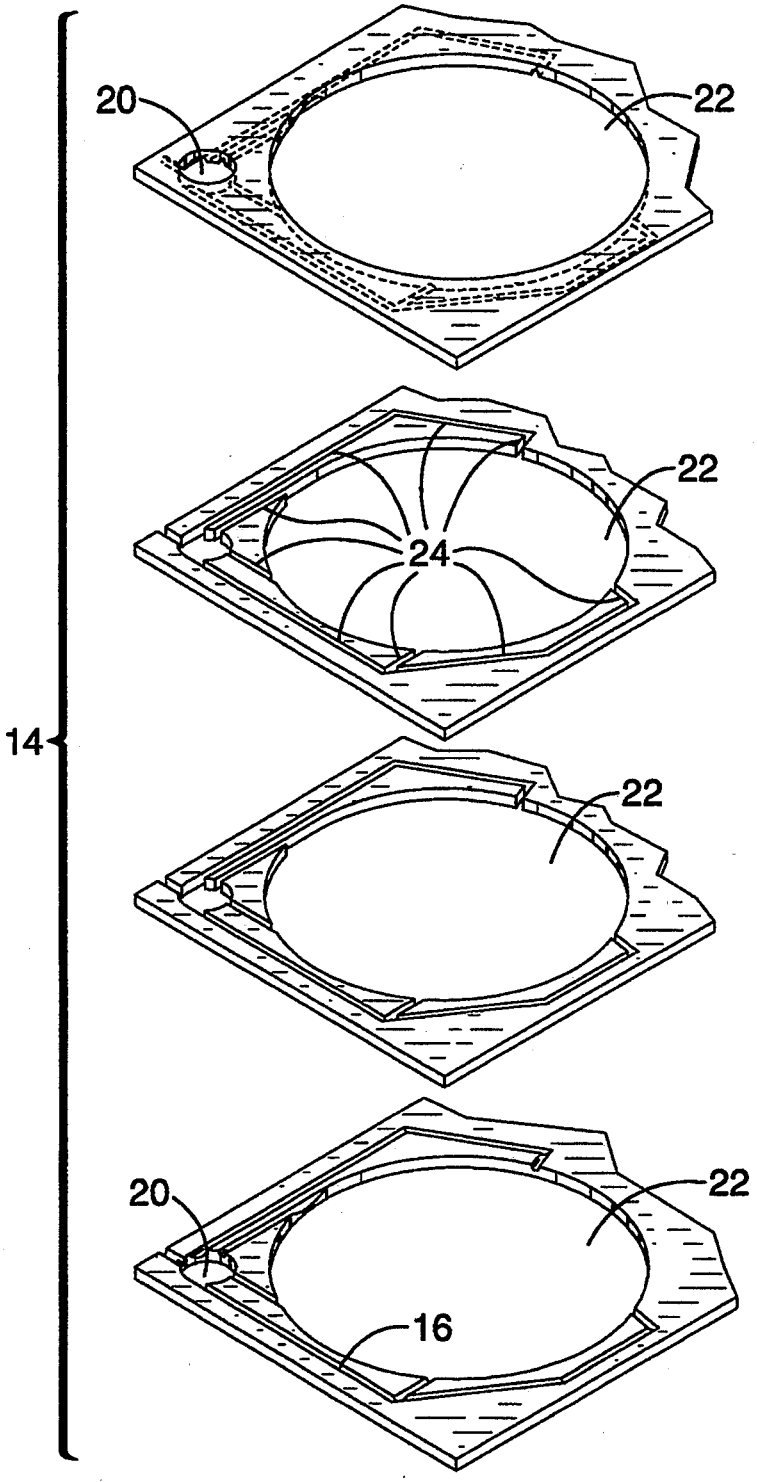
FIG. 5 is an enlarged exploded view of a portion of the large cavity of the middle members of the injector body of FIG. 2 showing the varying depths of the linear indentations thereupon.

FIG. 5, FIG. 6, and FIG. 7 more closely illustrate the concept of the linear indentations 16 which comprise the patterns 24. As shown, the middle members 14 have linear indentations 16 of varying depths, with preferably, the innermost of the middle members 14 having linear indentations 16 which completely penetrate middle members 14 and the outermost of middle members 14 having linear indentations 16 of a shallower depth. In this fashion, when the top members 12, middle members 14 and bottom members 18 are stacked and coupled together in precise order, the linear indentations 16 of the outermost and innermost of middle members 14 join together to form passages 40.

Referring again to FIG. 1, FIG. 2 and FIG. 4, it can be seen that passages 40 communicate with two types of cavities, an inlet cavity 30 and an outlet cavity 32. In the preferred embodiment, inlet cavity 30 serves to pressurize fuel or other material entering into its confines, and outlet cavity 32 receives the pressurized material from inlet cavity 30 for injection into a chosen location such as a cylinder or other combustion chamber. Inlet cavity 30 and outlet cavity 32 are formed in the space defined by first cutout 20 and second cutout 22, respectively, each of which have a defined boundary. The successive stacking of the top 12, middle 14 and bottom 18 members of injector body 10 results in the formation of first cavity 30 and second cavity 32, and the precise order of stacking further results in the formation of inlet ports 34 in inlet cavity 30 and outlet ports 36 in outlet cavity 32. It is important to note that the size and shape of inlet ports 34 and outlet ports 36 can be readily varied by altering the chemical etching process to create either shallower or deeper linear indentations 16. It is also important to note that the sizes of passages 40 can be varied to the extent necessary to ensure that fuel exits all outlet ports 36 at the same pressure and flow rates.

In the preferred embodiment, inlet cavity 30 of injector body 10 is adapted to communicate with a pressurization means 50. Various devices designed to create a pressure gradient may suffice to serve as pressurization means 50 but, in the preferred embodiment, pressurization means 50 comprises a cylinder 54 and piston 52. For example, pressurization means 50 could be eliminated altogether and any conventional pressurization means such as a pump or the like could be used to introduce pressurized materials into external passage 42. In such embodiments, inlet cavity 30 could be configured and structured as shown but capped off, or inlet cavity 30 could be eliminated and inlet ports 34 directly coupled to fuel feed port 44.

The function of pressurization means 50 or any other internal or external pressurization means coupled to the apparatus, is to facilitate the movement of fuel or other material through injector body 10. In the preferred embodiment, inlet cavity 30 receives fuel through external passage 42. External passage 42 terminates at fuel feed port 44 and serves as an inlet for transporting fuel into inlet cavity 30 of injector body 10. Furthermore, external passage 42 may communicate with an external pumping source which supplies fuel to external passage 42 and subsequently to inlet cavity 30. If the injector body 10 is being used to inject fuel to an engine for example, a conventional fuel pump could serve as the external pumping source communicating with external passage 42. Pressurization means 50 facilitates the movement of fuel into and out of inlet cavity 30 by alternately creating a negative pressure and a positive pressure in inlet cavity 30. In the preferred embodiment, piston 52 of pressurization means 50 alternates between an upstroke and a downstroke, the upstroke of piston 52 creating a negative pressure, thus drawing fuel into inlet cavity 30 through external passage 42. Alternately, the downstroke of piston 52 creates a positive pressure inside inlet cavity 30 thus facilitating the movement of fuel into passages 40, the positive pressure in inlet cavity 30 propelling the material through passages 40, the material exiting into outlet cavity 32 through outlet ports 36.

In a preferred embodiment, injector body 10 of the apparatus can be fitted between the cylinder head and engine block of an internal combustion engine. When the injector body 10 is used in this arrangement, the outlet cavity 32 is preferably circular and of a matching circumference to the cylinder of the internal combustion engine in which the injector body 10 is being used. Also, the injector body 10 can be adapted to inject numerous cylinders in a multi-cylinder engine. The outlet cavity 32 preferably communicates which numerous passages 40, the passages 40 exiting into the cylinder of the internal combustion engine in a preferably circular arrangement of outlet ports 36. The circular arrangement of outlet ports 36 allows for the fuel to be injected into the cylinder in a circular arrangement, which allows the fuel to be burned in a more efficient manner. Note that the spacing between outlet ports 36 can be either uniform or non-uniform depending upon the particular requirements of the combustion chamber although, in the preferred embodiment, uniform spacing is used.

Alternately, in other embodiments, it is envisioned that the injection apparatus disclosed herein be adapted for delivering a variety of liquids other than combustible fuels. For example, coolants such as water or the like could be injected to cool the combustion chamber prior to injecting fuel. Additionally, the injector body 10 need not be limited to having a single inlet cavity 30 for pressurizing the liquid to be transported and a single outlet cavity 32 for injecting the liquid with a single set of passages 40 uniting the two cavities. For example, it would be within the contemplation of the present invention to have a plurality of inlet cavities 30 aligned in series to provide needed pressure boosts to the liquid as it moves downs passages 40 toward outlet cavity 32. Likewise it is contemplated that numerous outlet cavities 32 could be fed by a single inlet cavity 30.

Regarding the types of liquids which can be delivered through injector body 10, no limits are placed upon the invention. Furthermore, gaseous materials could be injected with the present invention. The volume of material delivered over a point in time will be limited only by the size of the passages 40 and the force applied to the material supplied by the pressurization means 50.

Additionally, the volume of materials transported can range from large to microscopic quantities. It is therefore contemplated that the chemical etching process used to make linear indentations 16 be of a precision capable of reducing the subsequent size of the passages 40 to a dimension capable of delivering microscopic quantities of material.

The shapes of the patterns 24 of linear indentations 16 are intended to be unlimited, as well as the shapes of inlet cavity 30 and outlet cavity 32. Additionally, if a particular application necessitates it, the cavities need not have continuous walls, but instead the wall containing inlet ports 34 and outlet ports 36 may be broken at a point for whatever purpose. Additionally, the inlet ports 34 and outlet ports 36 need not be confined to circular arrangements about inlet cavity 30 and outlet cavity 32, respectively, but can be arranged in any manner suiting the particular application for which the apparatus is in use.

Additionally, the injector body 10 of the present invention may be constructed from a solid, non layered piece of material or materials. In such a case, the inlet and outlet cavities 30 and 32 respectively, would be placed into the material by any suitable means and the passages 40 and external passages 42 would be placed into the injector body by a suitable means. One such suitable means would be to drill passages 40 and external passage 42 using a drill of appropriate diameter.

Accordingly, it will be seen that this invention provides for efficient and effective delivery of fuels and other materials at uniform pressure through a series of passages 40. The apparatus includes a plurality of plate-like members divisible into top members 12, middle members 14 and bottom members 18, wherein the middle members 14 have linear indentations 16 etched upon their surfaces, the indentations 16 creating a series of passages 40 upon stacking the layers in precise order. The passages 40 serve as routes for delivering material from an inlet cavity 30 to an outlet cavity 32.

Although the description above contains many specificities, these should not be construed as limiting the scope of the invention but as merely providing illustrations of some of the presently preferred embodiments of this invention. Thus the scope of this invention should be determined by the appended claims and their legal equivalents.

I claim:

1. An apparatus for uniform injection of material comprising:

(a) a generally planar body member, said body member having first and second sides, said body member including outlet cavity means for dispensing material, said outlet cavity means having a defined boundary, said body member including inlet cavity means for receiving material; and (b) a plurality of passages, each said passage including an inlet port and an outlet port, each said inlet port opening into said inlet cavity means, each said outlet port opening into said outlet cavity means, said outlet ports disposed around said boundary of said outlet cavity means.

2. An apparatus as recited in claim 1, further comprising:

(a) a feed port, said feed port opening into said inlet cavity means; and (b) pressurization means for pressurizing material in said inlet cavity means.

3. An apparatus as recited in claim 2, wherein said pressurization means comprises:

(a) a cylinder body, said cylinder body having first and second ends, said cylinder body having a piston cavity extending between said first and second ends, said first end of said cylinder body disposed within said inlet cavity means;

(b) a piston, said piston slidably disposed within said piston cavity; and (c) means for reciprocating said piston.

4. An apparatus as recited in claim 3, wherein said apparatus is configured and structured for positioning between a cylinder head and a block of an engine.

5. An apparatus as recited in claim 4, wherein said apparatus is composed of a plurality of generally planar members.

6. An apparatus for uniform injection of fuel into an internal combustion engine, comprising:

(a) a generally planar body member, said body member having first and second sides, said body member including outlet cavity means for dispensing fuel into a combustion chamber, said outlet cavity means having a circumference, said body member including inlet cavity means for receiving fuel; and (b) a plurality of fuel passages, each said fuel passage including an inlet port and an outlet port, each said inlet port opening into said inlet cavity means, each said outlet port opening into said outlet cavity means, said outlet ports disposed around said circumference of said outlet cavity means.

7. An apparatus as recited in claim 6, further comprising:

(a) a fuel feed port, said fuel feed port opening into said inlet cavity means; and (b) fuel pressurization means for pressurizing fuel in said inlet cavity means.

8. An apparatus as recited in claim 7, wherein said fuel pressurization means comprises:

(a) a cylinder body, said cylinder body having first and second ends, said cylinder body having a piston cavity extending between said first and second ends, said first end of said cylinder body disposed within said inlet cavity means;

(b) a piston, said piston slidably disposed within said piston cavity; and (c) means for reciprocating said piston.

9. An apparatus for delivering a quantity of material comprising:

(a) a plurality of generally planar members, each of said members having a plurality of surfaces, said members further being divisible into top, middle and bottom members;

(b) said middle members having a pattern placed upon said surfaces, said pattern being similar on each of said middle members;

(c) said top, bottom and middle members being coupled together, said pattern upon said middle members communicating to create a passage for allowing said material to travel through;

(d) said passage communicating between an inlet cavity means and an outlet cavity means formed in said apparatus.

10. An apparatus as recited in claim 9, further comprising:

(a) a fuel feed port, said fuel feed port opening into said inlet cavity means; and (b) fuel pressurization means for pressurizing fuel in said inlet cavity means.

11. An apparatus as recited in claim 10, wherein said fuel pressurization means comprises:

(a) a cylinder body, said cylinder body having first and second ends, said cylinder body having a piston cavity extending between said first and second ends, said first end of said cylinder body disposed within said inlet cavity means;

(b) a piston, said piston slidably disposed within said piston cavity; and (c) means for reciprocating said piston.

12. An apparatus as recited in claim 11, wherein said patterns upon said middle members are comprised of a plurality of indentations.

13. An apparatus as recited in claim 12, wherein said indentations upon said middle members vary in depth.

14. An apparatus as recited in claim 13, wherein said apparatus is positionable between a cylinder head and a block of an engine.

* * * * *